US006367676B1

(12) United States Patent
Opland et al.

(10) Patent No.: US 6,367,676 B1
(45) Date of Patent: Apr. 9, 2002

(54) EJECTION FORCE ADJUSTABLE STAPLER

(76) Inventors: Samuel Opland, 88 Peregrine Rd., Newton, MA (US) 02459; Lun-Hai Yeh, 3F, No. 19, Lane 73, Chang-Tai Street, Wan-Hua Area, Taipei (TW)

( * ) Notice: Subject to any disclaimer, the term of this patent is extended or adjusted under 35 U.S.C. 154(b) by 0 days.

(21) Appl. No.: 09/894,411

(22) Filed: Jun. 28, 2001

(51) Int. Cl.[7] ..... B25C 5/11
(52) U.S. Cl. ..... 227/123; 227/127; 227/132
(58) Field of Search ..... 227/123, 127, 227/128, 156, 120

(56) References Cited

U.S. PATENT DOCUMENTS

| | | | | | |
|---|---|---|---|---|---|
| 2,150,332 | A | | 3/1939 | Maynard | |
| 2,265,361 | A | | 12/1941 | Drypolcher | |
| 2,420,258 | A | | 5/1947 | Maynard | |
| 2,472,032 | A | * | 5/1949 | Wandel | 227/123 |
| 4,126,260 | A | * | 11/1978 | Mickelsson | 227/132 |
| 4,436,236 | A | * | 3/1984 | Jobe | 227/123 |
| 4,452,388 | A | | 6/1984 | Fealey | 227/132 |
| 5,335,839 | A | | 8/1994 | Fealey | 227/132 |
| 5,350,103 | A | * | 9/1994 | Monacelli | 227/123 |
| 5,642,849 | A | * | 7/1997 | Chen | 227/123 |
| 5,816,470 | A | * | 10/1998 | Plato et al. | 227/132 |

* cited by examiner

*Primary Examiner*—Scott A. Smith
(74) *Attorney, Agent, or Firm*—Ostrolenk, Faber, Gerb & Soffen, LLP

(57) ABSTRACT

A stapler includes a casing having a grasp hole defined therethrough and a staple receiving frame is received in the casing. A staple pushing device is engaged with the frame and a groove is defined in a periphery of the grasp hole so that a pressing rod is movably engaged with the groove. Two resilient plates each have an end fixedly connected to the casing and the pressing rod presses on the resilient plates. A staple ejection device is connected to the casing and is connected to the resilient plates. A handle is pivotally connected to the casing and disengagably connected to the staple ejection device. An outer cover is mounted to the casing and a front cover is removably connected to the casing.

6 Claims, 11 Drawing Sheets

EJECTION FORCE ADJUSTABLE STAPLER

FIELD OF THE INVENTION

The present invention relates to a stapler wherein the force that ejects staples can be adjustable.

BACKGROUND OF THE INVENTION

A conventional stapler generally includes a casing with a push type handle which is cooperated with a resilient member which is deformed to store energy when the handle is pushed. The resilient member is linked with an ejection device which is moved at a speed by the energy of the resilient member when the handle is disengaged from the resilient member by pushing the handle to a position. The ejection device ejects a staple via a guide member of the stapler and the staple staples sheet of document together. However, the staples are urged by a spring in the stapler so as to feed the following staples to the position to be ejected. It could be dangerous when the user put new staples from a front end of the stapler because the staples could be bounced by the spring. The ejection device is sealed in the casing of the stapler so that it is difficult for the users to maintain the ejection device which will be worn out. The ejection force of the stapler cannot be adjusted.

SUMMARY OF THE INVENTION

In accordance with one aspect of the present invention, there is provided a stapler which comprises a casing having a grasp hole defined therethrough and a staple receiving frame is received in the casing. A staple pushing device is engaged with the frame and includes a push plate slidably mounted to the staple receiving frame. A groove is defined in a periphery of the grasp hole and a pressing rod is movably engaged with the groove. Two resilient plates each have an end fixedly connected to the casing and the pressing rod presses on the resilient plates. A horizontal plate is located in the casing and has two slots. A staple ejection device is connected to the casing and has a base plate and an ejection plate. The base plate and the ejection plate both are connected to the resilient plates. A handle is pivotally connected to the casing and disengagably connected to the staple ejection device. An outer cover is mounted to the casing and a front cover is connected to the casino and mounted to the outer cover. The front cover has a guide member and a grasp member which is pivotally connected to the guide member. The guide member has two hooks which are engaged with the two slots of the horizontal plate in the casing. The grasp member is engaged onto the outer casing.

The present invention will become more obvious from the following description when taken in connection with the accompanying drawings which show. for purposes of illustration only, a preferred embodiment in accordance with the present invention.

DETAILED DESCRIPTION OF THE INVENTION

Figure 1:
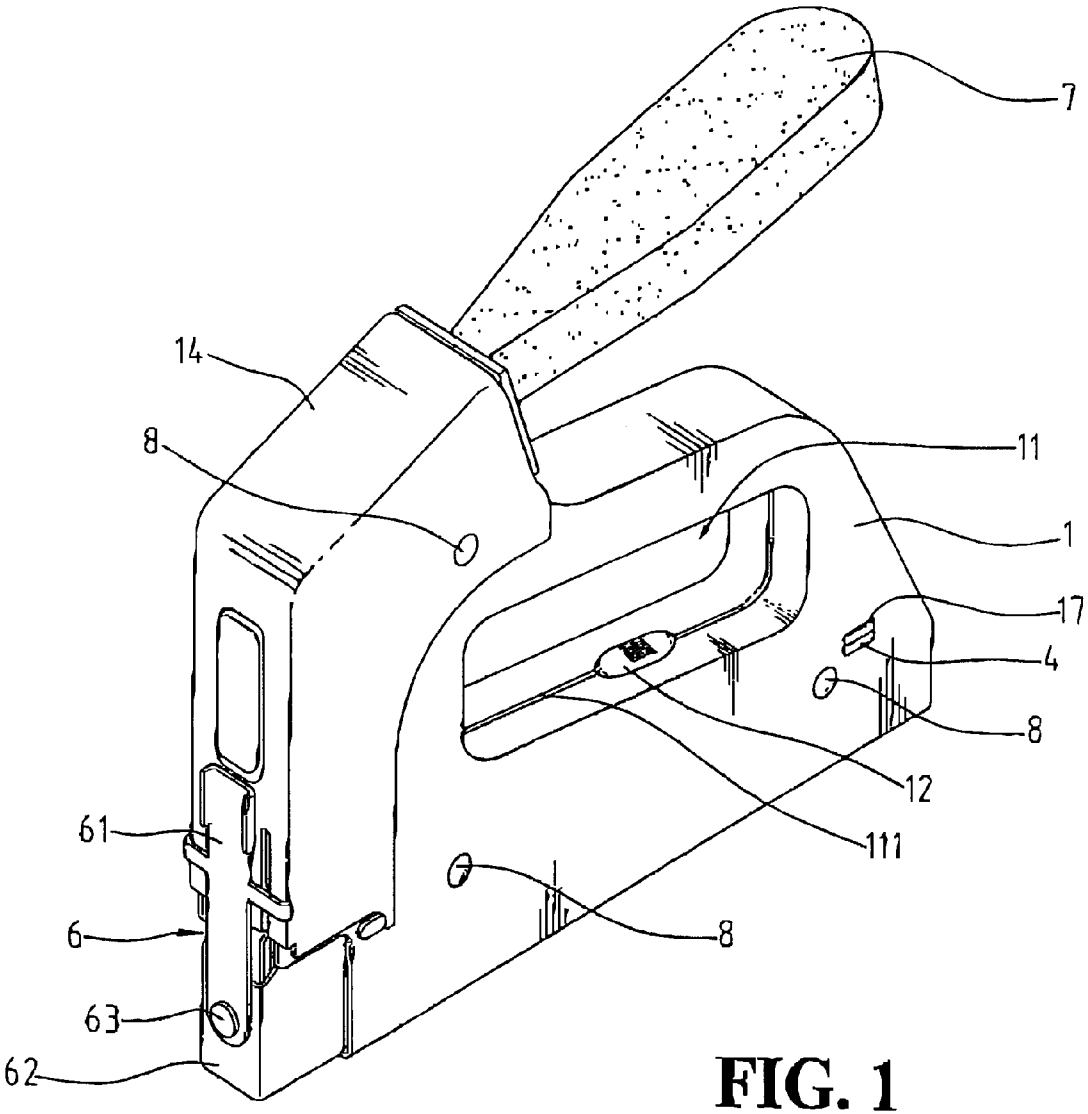
FIG. 1 is a perspective view to show the stapler of the present invention.
Figure 2:
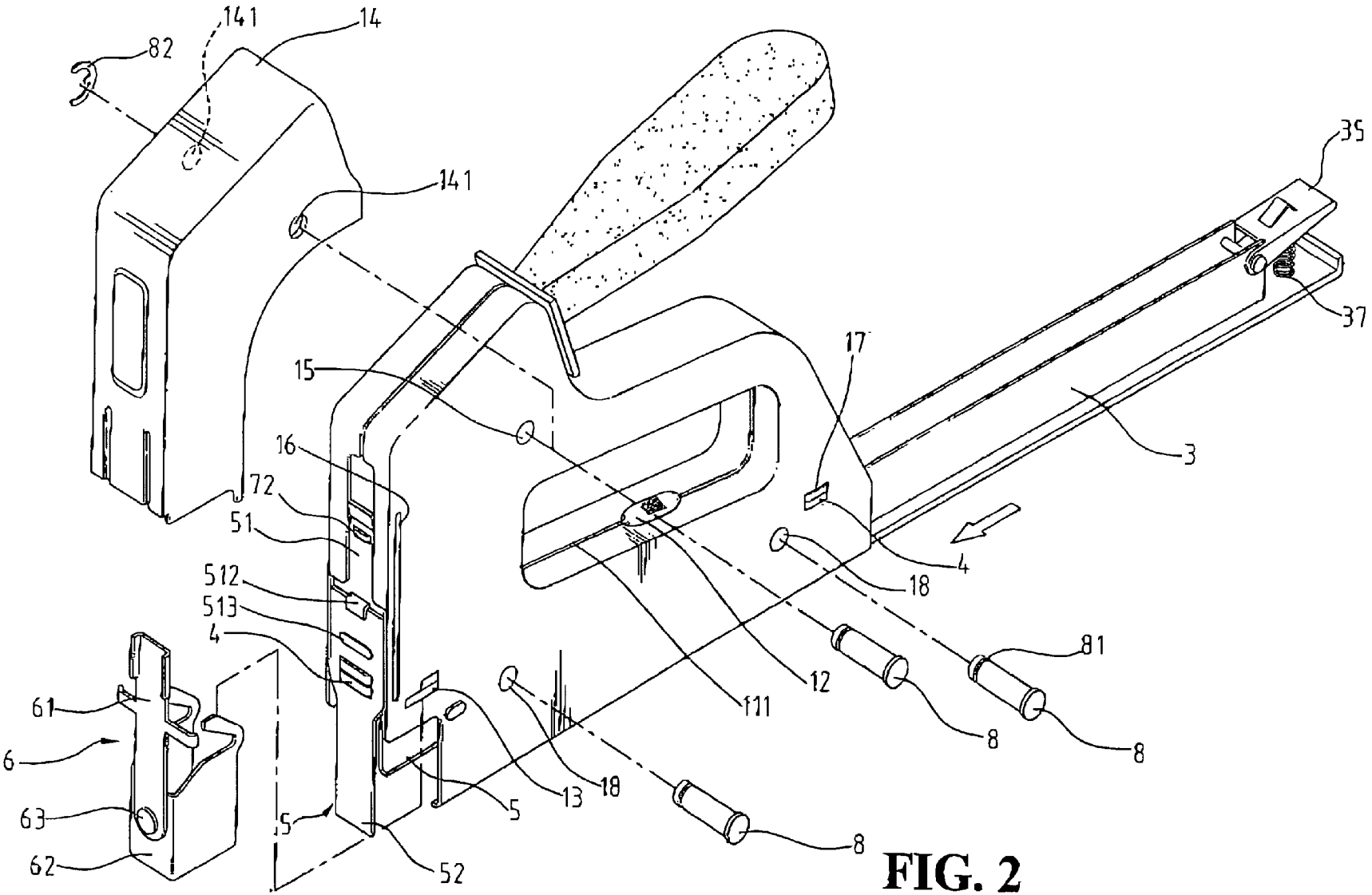
FIG. 2 is an exploded view to show the stapler of the present invention.
Figure 3:
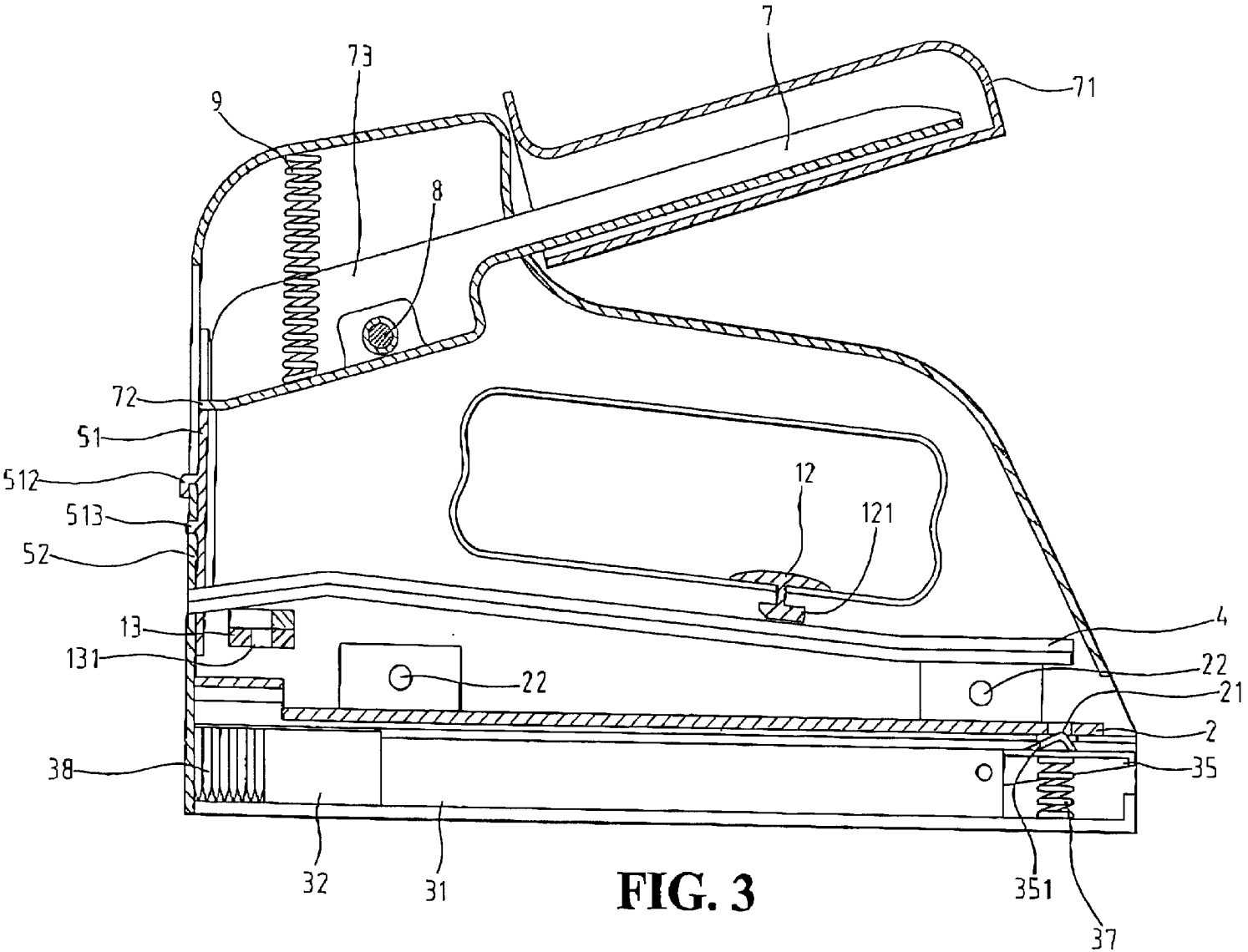
FIG. 3 is a cross sectional view to show the stapler of the present invention.

Referring to FIGS. 1, 2 and 3, the stapler of the present invention comprises a hollow casing 1 having a grasp hole 11 for the user's hand to grasp the stapler. A groove 111 is defined in a periphery defining the grasp hole 11 and a button 12 is movably engaged with the groove 111. The lower end of the button 12 has a pressing rod 121 located in the casing 1. Three holes 15, 17 and 18 are defined in each side of the casing 1 and two elongate grooves 16 are defined in two sides of the front end of the casing 1. A horizontal plate 13 is located in the casing 1 and close to the front end of the casing 1. The horizontal plate 13 has two slots 131. An outer cover 14 is mounted to the front end of the casing 1 and has two holes 141 in two sides thereof.

A staple receiving frame 2 is an inverted U-shaped member and has a hole 21 defined in a rear end thereof. The frame 2 is fixed connected in the casing 1 by extending pins 8 through the holes 18 and the holes 22 defined through the frame 2.

Figure 4:
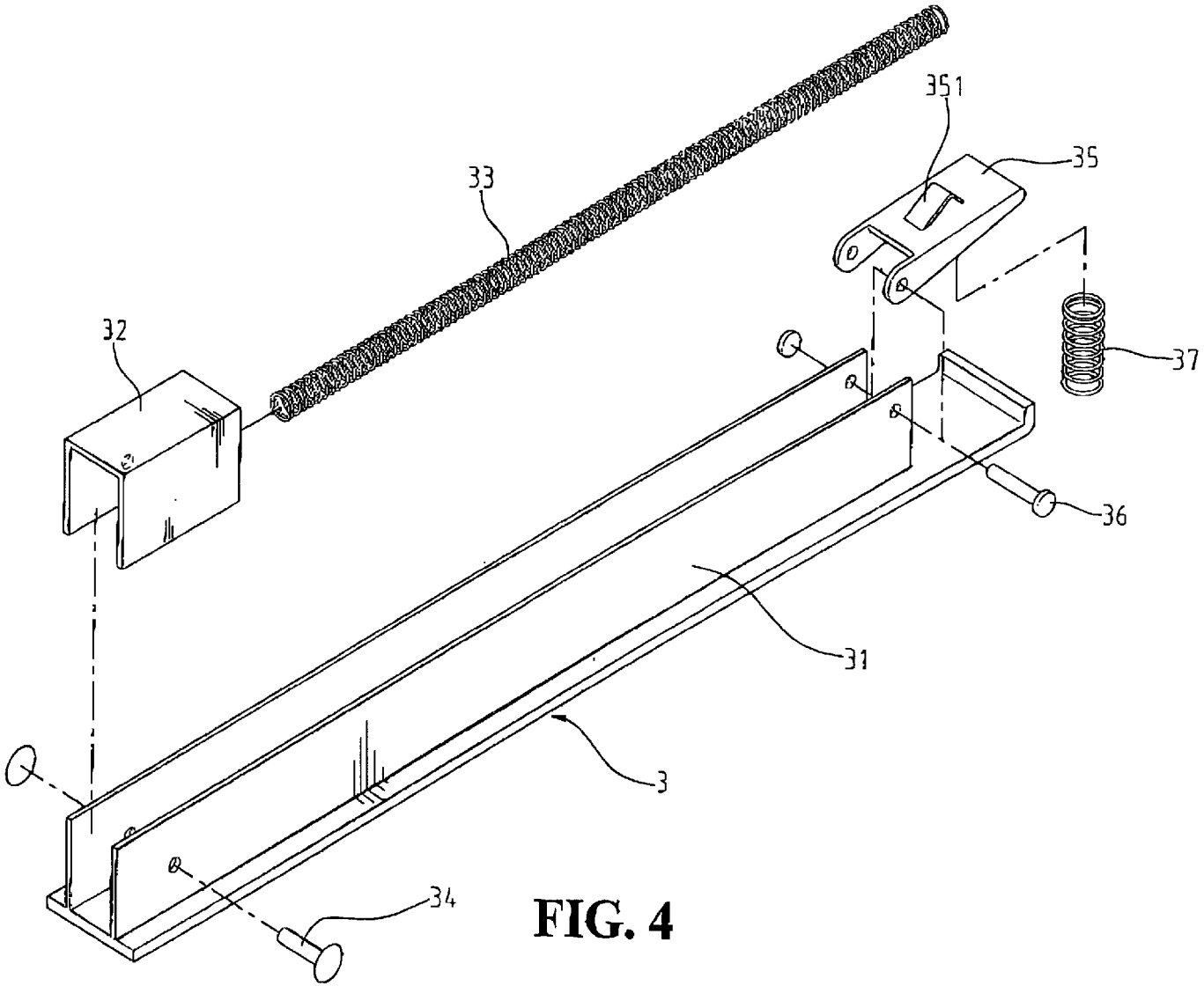
FIG. 4 is an exploded view to show the staple push plate of the present invention.
Figure 5:
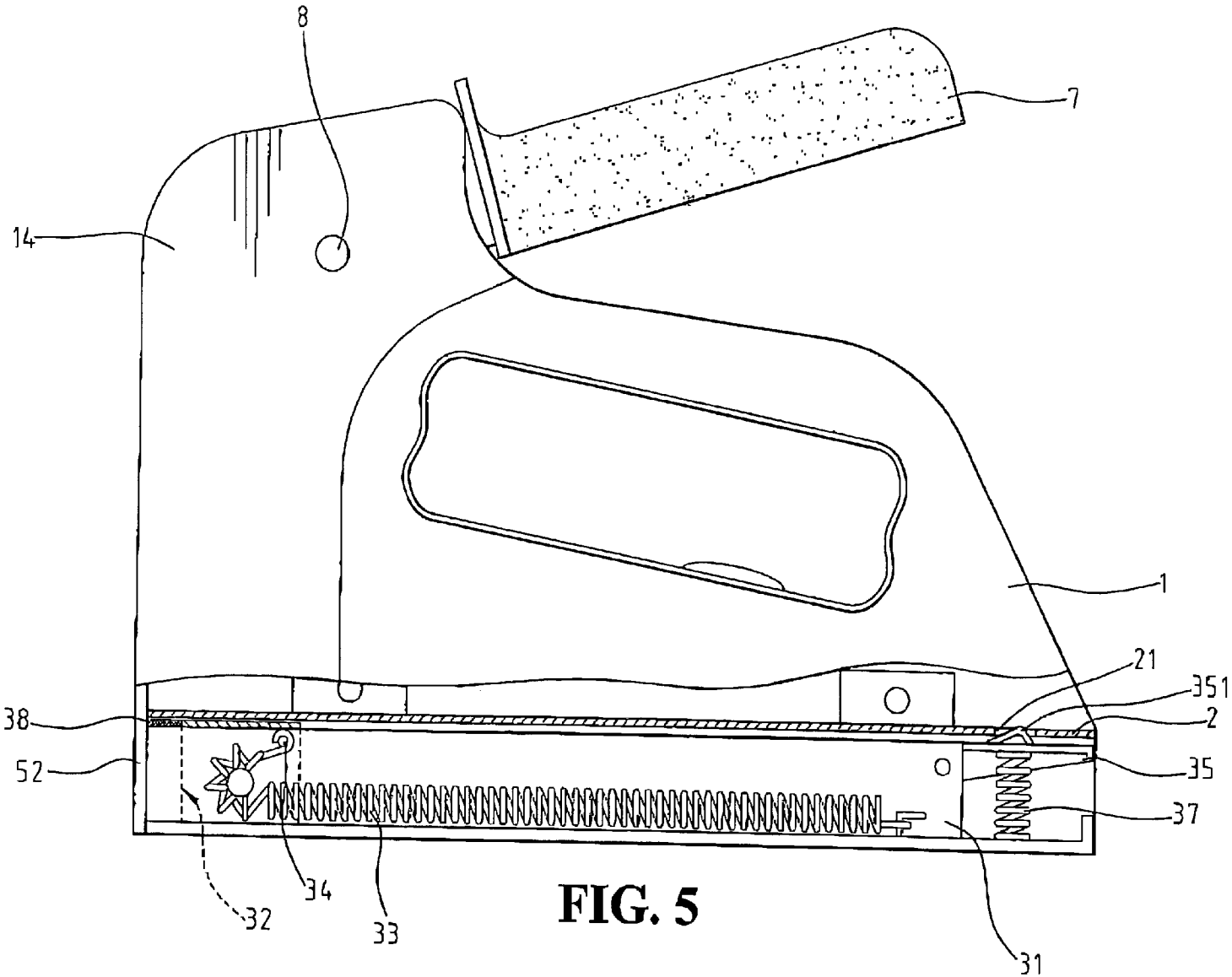
FIG. 5 is a cross sectional view to show the staple push plate received in the stapler of the present invention.

Referring to FIGS. 4 and 5, the staple pushing device 3 is movably engaged with the frame 2 and includes a base 31 on which a push plate 32 is slidably mounted. A short rod 34 extends transversely on the first end of the base 31 and a spring 33 is received in the base 31. The first end of the spring 33 is fixedly connected to the base 31 and the second end of the spring 33 goes around the short rod 34 and is connected to the push plate 32. A press plate 35 is connected to the second end of the base 31 by a pin 36 and has a protrusion 351. A spring 37 is connected between the press plate 35 and the base 31. The staple pushing device 3 is positioned in the frame 2 by engaging the protrusion 351 with the hole 21 in the frame 2. The protrusion 251 is disengaged from the hole 21 by pressing the press plate 35 so that the staple pushing device 3 can be pulled back and the user may put staples 38 from the front end of the frame 2. The staples 38 are urged by the push plate 32. The type of the spring 37 can be a torsion spring or other similar springs.

Two resilient plates 4 each have an end fixedly connected to the holes 17 of the casing 1 and the pressing rod 121 presses on the resilient plates 4.

Figure 6:
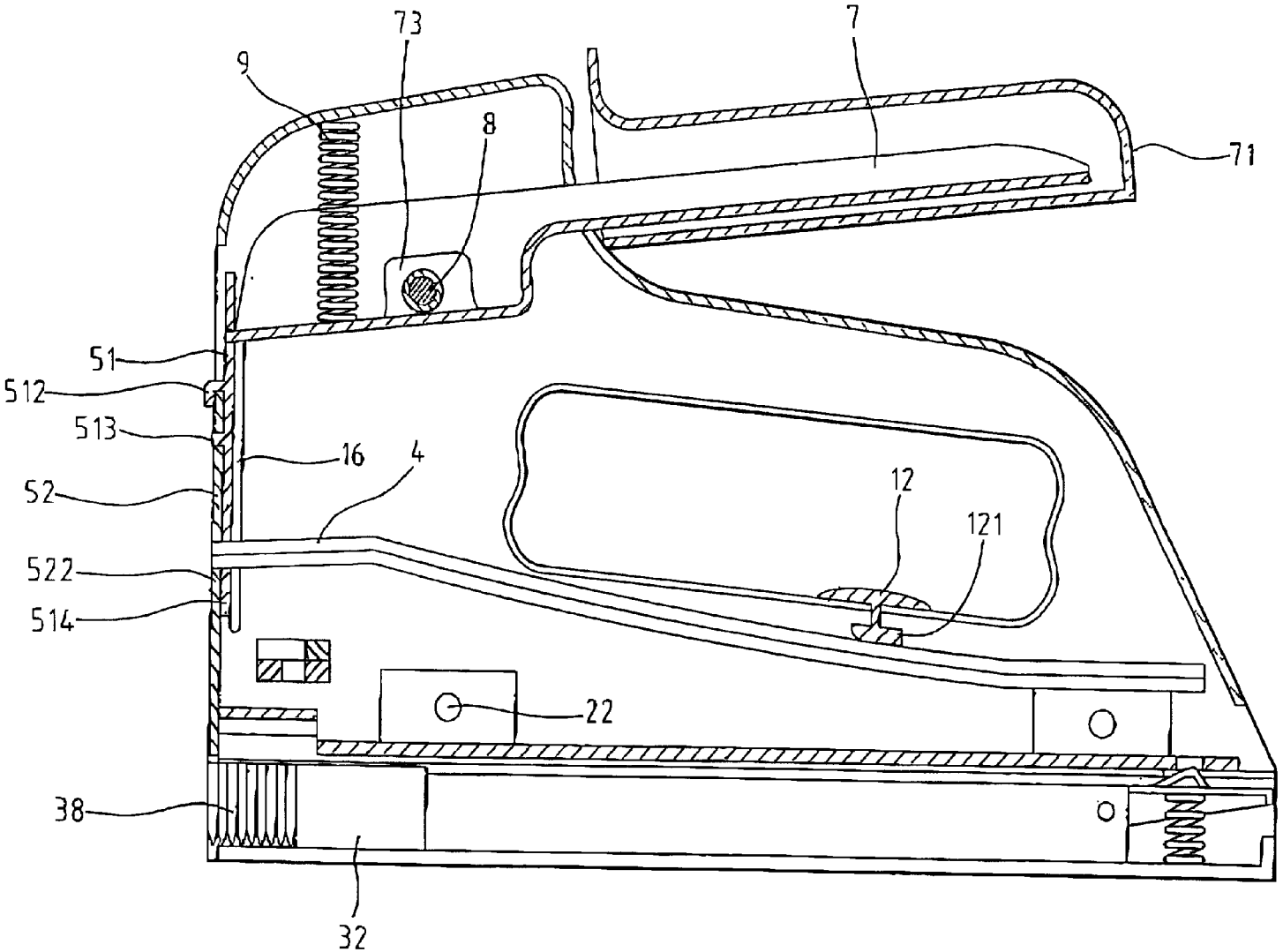
FIG. 6 is a cross sectional view to show the handle of the present invention is pushed downward.
Figure 7:
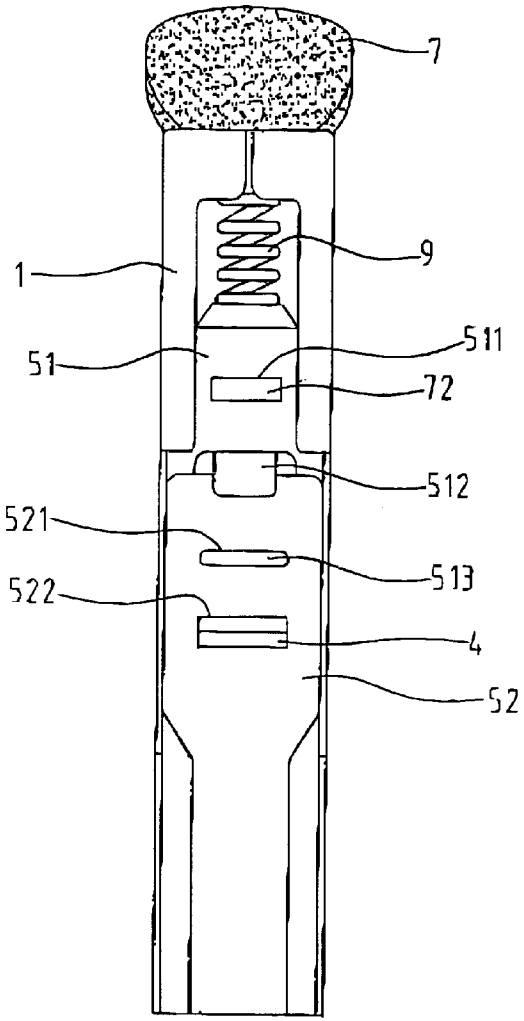
FIG. 7 is an end view to show the staple ejection device of the stapler of the present invention.
Figure 8:
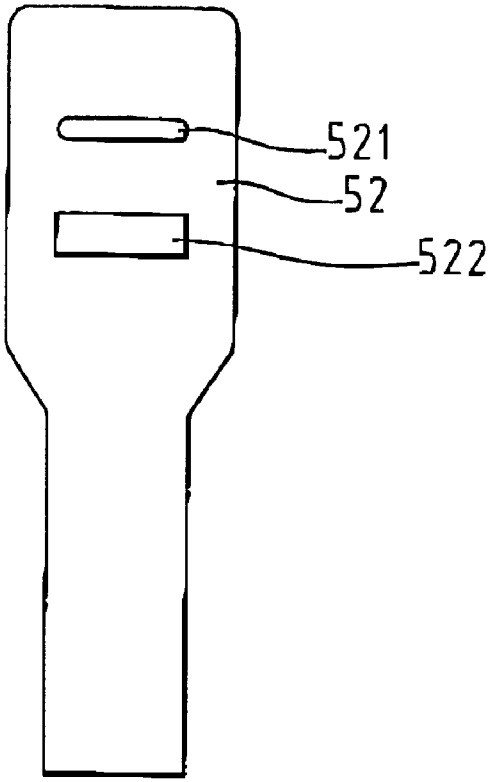
FIG. 8 is a plan view to show the ejection plate of the staple ejection device of the stapler of the present invention.

As shown in FIGS. 3 and 6, the staple ejection device 5 is located in the casing 1 and movably vertically engaged with the two elongate grooves 16. The staple ejection device 5 includes base plate 51 and an ejection plate 52 as shown in FIGS. 6 and 7. The base plate 51 has a hole 511, a tongue 512, a ridge 513 and a slot 514. As shown in FIGS. 6 and 8, a top end of the ejection plate 52 is engaged with the tongue 512 and the ridge 513 of the base plate 51 is engaged with a hole 521 in the ejection plate 52. A hole 522 is located in alignment with the slot 514 of the base plate 51.

Figure 9:
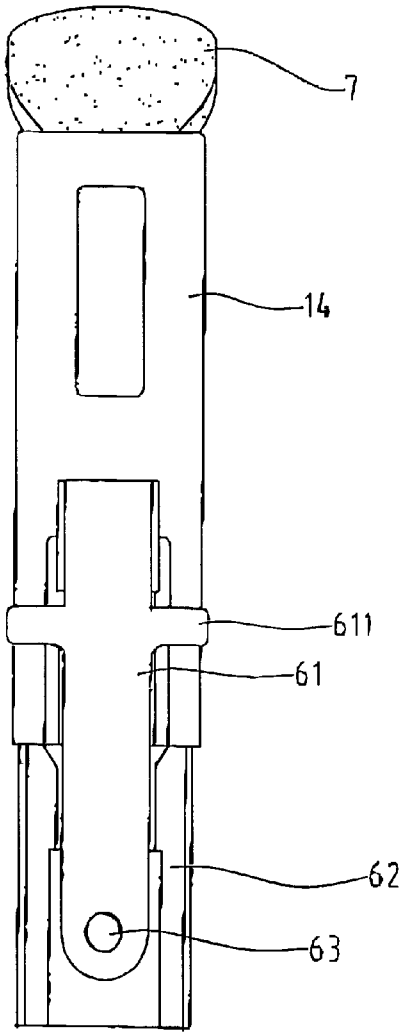
FIG. 9 is a front end view to show a front cover mounted on the staple ejection device of the stapler of the present invention.
Figure 10:
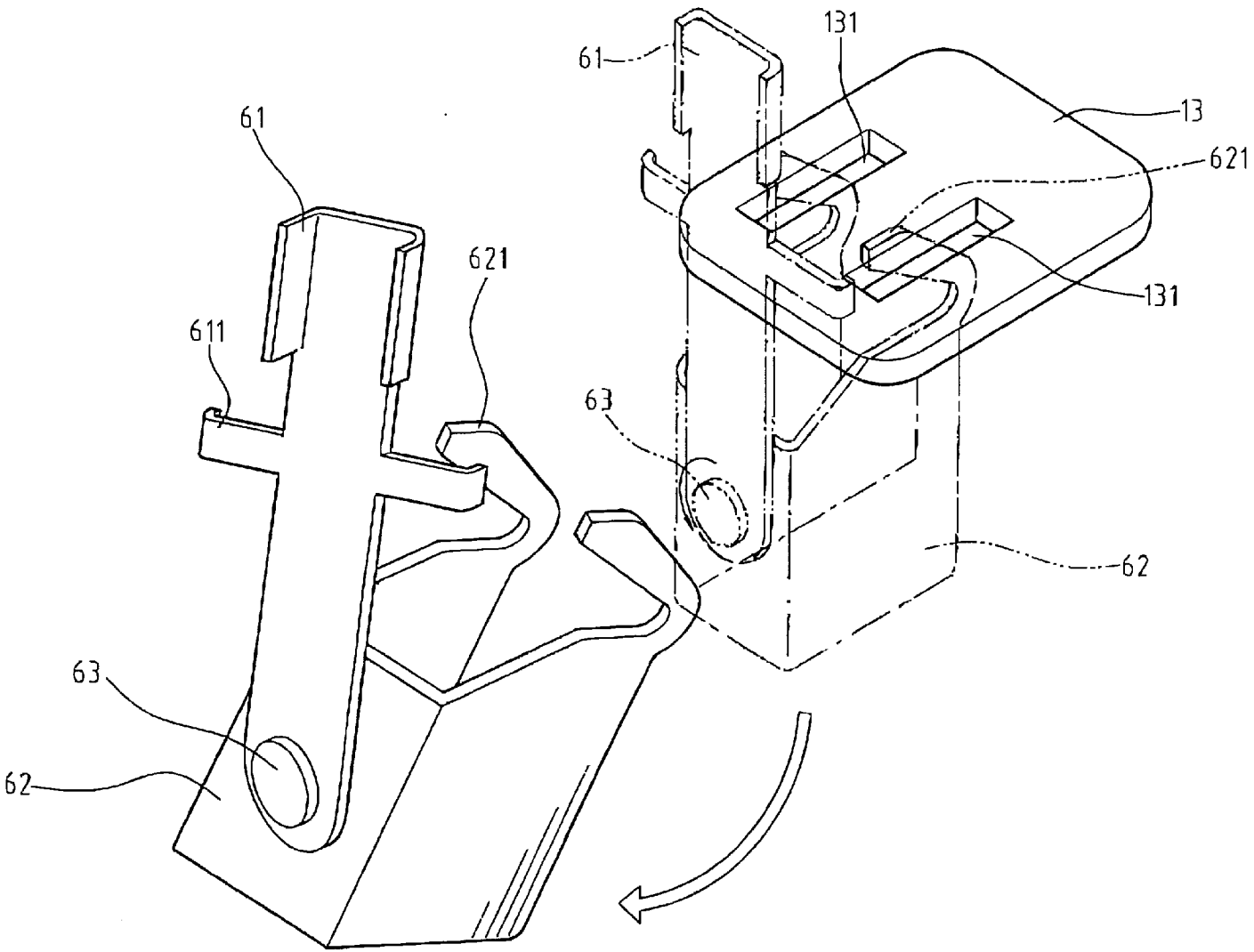
FIG. 10 is an illustrative view to show the front cover and the horizontal plate in the stapler of the present invention.
Figure 11:
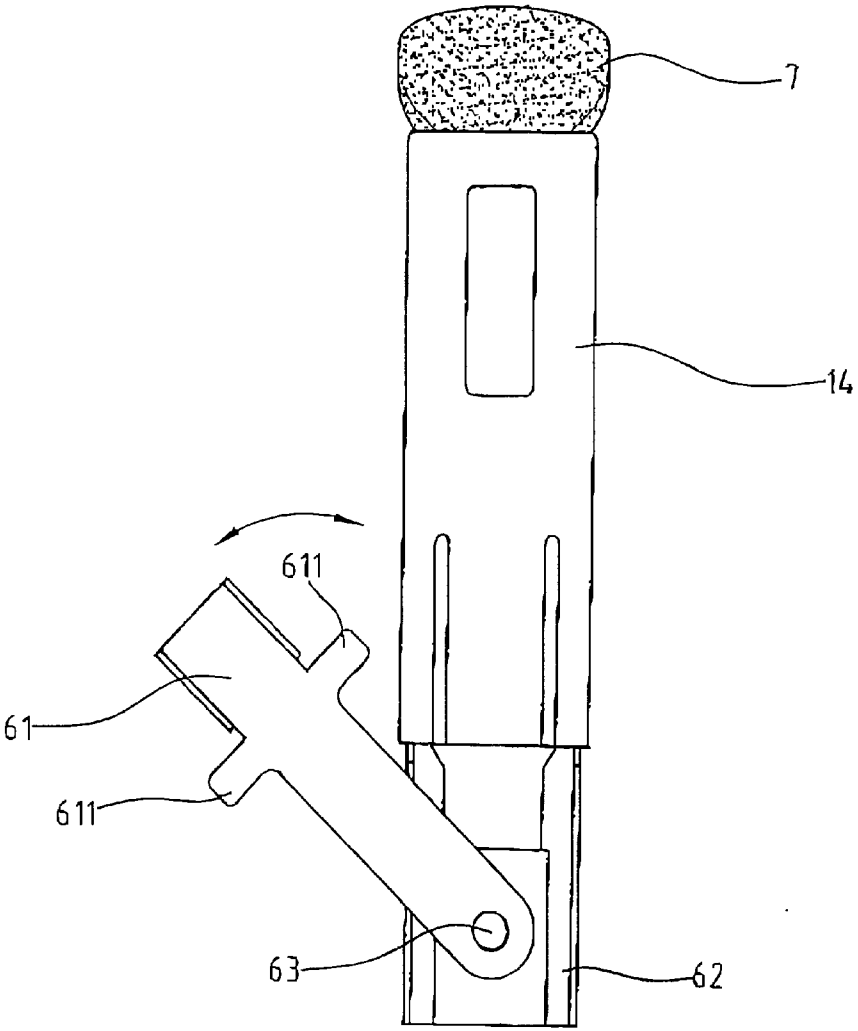
FIG. 11 shows that the grasp member on the front cover is pivoted relative to the front cover.

As shown FIGS. 1 and 9, the front cover 6 includes a guide member 62 and a grasp member 61 which is pivotally connected to the guide member 62 by a rivet 63. The grasp member 61 is mounted to the outer cover 14 and the guide member 62 has two hooks 621 which are engaged with the slots 131 of the horizontal plate 13 as shown in FIGS. 2 and 10. As shown in FIG. 11, when pivoting the grasp member 61, the guide member 62 can be pulled out inclinedly from the casing as shown in FIG. 10 and is disengaged from the horizontal plate 13.

The grasp member 61 has two pawls 611 which grasp on two sides of the outer cover 14 so as to reinforce the connection of the front cover 6 on the casing 1.

Referring to FIGS. 3 and 6. a handle 7 having a cover 71 is pivotally connected to the casing 1 by extending a pin 8 through the holes 141 in the outer cover 14, the holes 15 in the casing 1 and two holes 73 in a mediate portion of the handle 7. The handle 7 has an extension portion 72 which is engaged with the hole 511 of the base plate 51. A spring 9 is biased between a top of the casing 1 and an inside of the handle 7.

The pins 8 in the application has a flat end so as to engage with a periphery of the holes 141 and the other end of the pins 8 has a groove 81 with which a C-shaped clip 82 is engaged so as to engage with the other hole 141 in the outer cover 14. The pin may be replaced by a bolt and a nut.

As shown in FIG. 6, when the handle 7 is pushed downward, the extension portion 72 lifts the ejection device 5 and the resilient plates 4 is bent by the pressing rod 121. The staple 38 is pushed by the push plate 32 and contacts against the guide member 62. The extension portion 72 is disengaged from the ejection device 5 when the handle 7 is pushed to a position and the ejection device 5 is pushed by the releasing force of the resilient plates 4 to eject the staple 38. The handle 7 bounces back to its original position by the spring 9 and the extension portion 72 is engaged with the ejection device 5 again. The force that the resilient plates 4 applied on the ejection device 5 can be adjusted by moving the pressing rod 121. The outer cover 14 is easily to be disengaged from the casing 1 and the guide member is easily replaced.

While we have shown and described the embodiment in accordance with the present invention, it should be clear to those skilled in the art that further embodiments may be made without departing from the scope of the present invention.

What is claimed is:

1. A stapler comprising:

a casing having a grasp hole defined therethrough and a staple receiving frame received in said casing, a staple pushing device engaged with said frame and including a push plate slidably mounted to said staple receiving frame, a groove defined in a periphery of said grasp hole and a pressing rod movably engaged with said groove:

two resilient plates each having an end fixedly connected to said casing and said pressing rod pressing on said resilient plates a horizontal plate located in said casing and having two slots;

a staple ejection device connected to said casing and having a base plate and an ejection plate, said base plate and said ejection plate both connected to said resilient plates;

a handle pivotally connected to said casing and disengagably connected to said staple ejection device;

an outer cover mounted to said casing, and a front cover having a guide member and a grasp member which is pivotally connected to said guide member, said guide member having two hooks which are engaged with said two slots of said horizontal plate in said casing, said grasp member engaged onto said outer casing.

2. The stapler as claimed in claim 1, wherein said staple receiving frame has a hole and said staple pushing device has a press plate pivotally connected thereto, a protrusion extending from said press plate and engaged with said hole in said staple receiving frame, a spring biased between said press plate and said staple push device.

3. The stapler as claimed in claim 1, wherein said outer cover has two holes and a pin extends through said holes in said outer cover, said casing and said handle.

4. The stapler as claimed in claim 3, wherein said pin has a flat end on a first end thereof and a groove is defined in a second end of said pin, a C-shaped clip engaged with said groove in said pin.

5. The stapler as claimed in claim 1, wherein said ejection plate has a hole and said base plate has a tongue and a ridge, an end of said ejection plate being pressed by said tongue and said ridge being engaged with said hole in said ejection plate.

6. The stapler as claimed in claim 1, ther comprising two pawls extending frame said grasp member and engaged with two sides of said outer cover.

* * * * *